United States Patent [19]

Read, Jr. et al.

[11] 4,264,435

[45] Apr. 28, 1981

[54] CRUDE OIL CRACKING USING PARTIAL COMBUSTION GASES

[75] Inventors: Arthur E. Read, Jr.; Milton S. Wing, both of Lake Jackson; William P. Hancock, Brazoria, all of Tex.

[73] Assignee: The Dow Chemical Company, Midland, Mich.

[21] Appl. No.: 43,605

[22] Filed: May 29, 1979

Related U.S. Application Data

[63] Continuation-in-part of Ser. No. 903,299, Apr. 5, 1978, abandoned, which is a continuation-in-part of Ser. No. 827,484, Aug. 25, 1977, abandoned.

[51] Int. Cl.[3] ..... C07C 4/04; C10G 9/38

[52] U.S. Cl. ..... 208/129; 208/130; 585/652

[58] Field of Search ..... 208/129, 130; 585/652

[56] References Cited

U.S. PATENT DOCUMENTS

| | | | |
|---|---|---|---|
| 1,357,277 | 11/1920 | Day | 208/129 |
| 1,970,771 | 8/1934 | Russell | 208/129 |
| 2,194,574 | 3/1940 | Snyder | 208/129 |
| 2,377,847 | 6/1945 | Allen et al. | 208/129 |
| 2,698,830 | 1/1955 | Jenny | 208/129 |
| 2,750,420 | 6/1956 | Hepp | 208/130 |
| 4,134,824 | 1/1979 | Kamm et al. | 208/129 |
| 4,136,015 | 1/1979 | Kamm et al. | 208/129 |

FOREIGN PATENT DOCUMENTS

| | | | |
|---|---|---|---|
| 1440424 | 6/1976 | United Kingdom | 208/129 |

OTHER PUBLICATIONS

Hosoi et al., "Chemical Engineering Process," vol. 71, No. 11, Nov. 1975, pp. 63 to 67.

*Primary Examiner*—Herbert Levine
*Attorney, Agent, or Firm*—B. G. Colley

[57] ABSTRACT

Cracking of crude oil or crude oil residues is accomplished in an adiabatic reactor which follows a partial combustion zone with the injection of superheated or shift steam into the combustion gases.

Advantages are that the carbon monoxide produced by partial combustion is converted to carbon dioxide which is easily removed, there is no need to supply a separate source of fuel or hydrogen, and coke formation is substantially eliminated. The cracked oil produced in the process can be used as a quench oil and/or fuel to feed the partial combustion zone. The yields of olefins and aromatics is increased over processes using superheated steam cracking.

15 Claims, 1 Drawing Figure

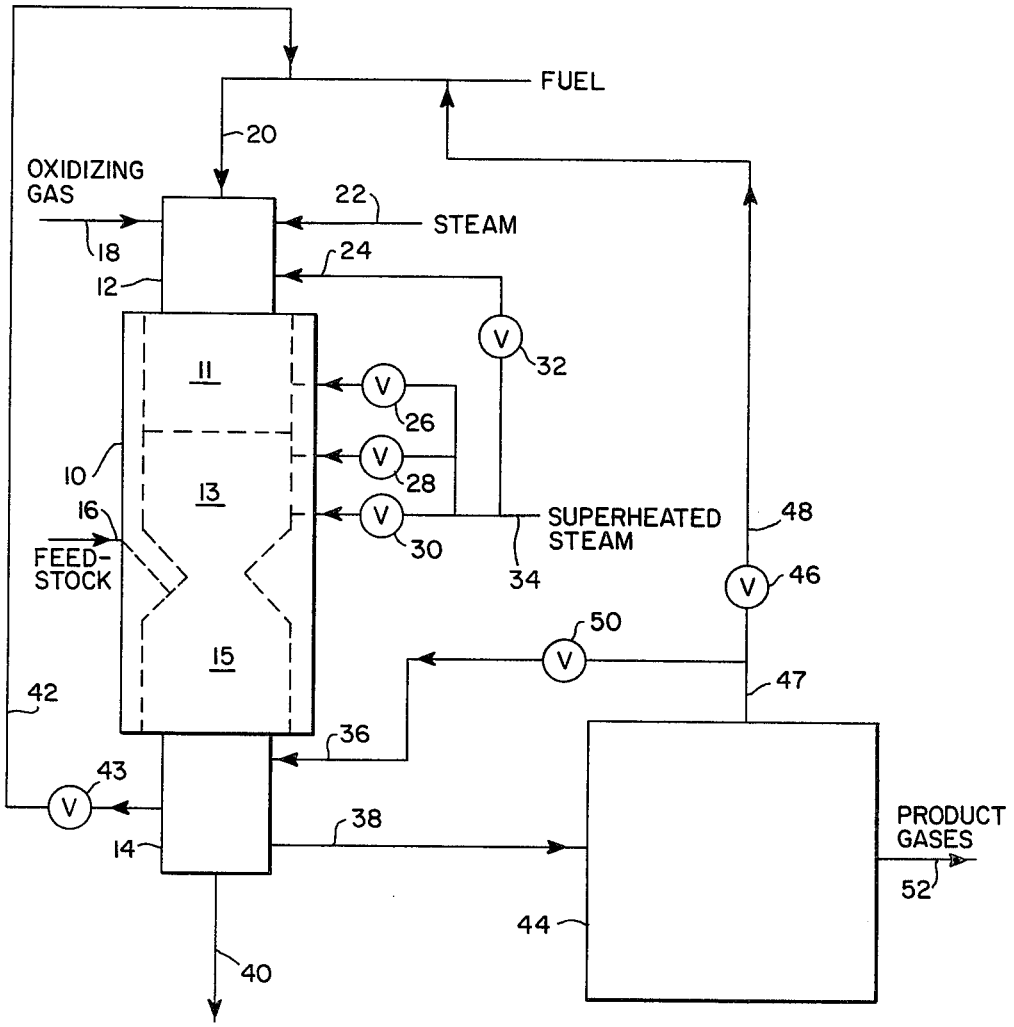
FUEL
20
OXIDIZING GAS
22
STEAM
18
24
12
V
32
11
V
26
10
V
28
13
16
V
30
SUPERHEATED STEAM
48
FEED-STOCK
34
V
46
50
V
15
47
42
36
43
V
38
PRODUCT GASES
14
52
44
40

CRUDE OIL CRACKING USING PARTIAL COMBUSTION GASES

CROSS REFERENCE TO RELATED APPLICATIONS

This is a continuation-in-part of Ser. No. 903,299 filed Apr. 5, 1978, which is a continuation-in-part of Ser. No. 827,484 filed Aug. 25, 1977 both now abandoned.

BACKGROUND OF THE INVENTION

This invention relates to a process for the cracking of crude oil using partial combustion gases wherein superheated steam, crude oil and oxygen are injected into a partial combustion zone at one or more points.

It is known in the prior art that crude oil and other hydrocarbon fractions may be thermally cracked by mixing superheated steam and the oil together and allowing the pyrolysis to proceed adiabatically. See, for example, French Pat. No. 1,577,043 dated Aug. 1, 1969, and S. Araki, et al. "Pyrolysis of Hydrocarbons Using Superheated Steam as Heat Carrier", World Petroleum Congress, Moscow, USSR. (September, 1971). These processes allow crude and heavy hydrocarbon fractions, which would foul conventional tubes, to be cracked and have the advantage that the steam diluent and heat carrier may be readily condensed from the products and a savings is thereby made as only the product gases need to be compressed for separation. Among the disadvantages of these processes are expense associated with the generation of the superheated steam in the 1699° to 2000° C. range generally required. Also among the by-products formed in the cracking process are heavy aromatic liquids and coke which foul reactors and heat exchangers and which contain high quantities of sulfur and metals which must be disposed of. Some of the problems associated with the generation of superheated steam have apparently been solved by using a hydrogen burner to generate high temperature gases, but the yields that may be obtained in this manner are still low and the by-products still remain a problem.

Other process for pyrolysis of heavy hydrocarbons involve the use of a partial or complete combustion burner, where the crude oil or fractions thereof to be cracked is sprayed into the hot gases from the burner. Examples of these are U.S. Pat. Nos. 2,244,636; 2,698,830; 2,912,475; 3,178,488; 3,236,763; 3,408,417; British Pat. No. 1,440,424; and Belgium Pat. No. 838,290. These processes avoid some of the problems associated with the generation of high temperature steam and (when partial combustion is used) also produce hydrogen gas which lowers the heat requried for cracking, increases ethylene yield, and aromatics yield, and reduced coke formation. See, for example, Kunugi, et al. "Pyrolysis of Hydrocarbons in Hydrogenselective Production of Ethylene" World Petroleum Congress (1967).

The main disadvantage of these processes is that large quantities of non-condensable gases (especially carbon monoxide) are produced, which must be compressed to be removed. This involves a considerable cost for large compressors and large size separation equipment.

In U.S. Pat. No. 4,134,824 a process is disclosed in which crude oil is first distilled to separate asphaltic components. The distillate is then cracked using partial combustion gases from a methane burner to generate ethylene with recycling of the asphaltic components to the burner. The main disadvange of this process appears to be the generation of pitch which must be disposed of.

SUMMARY OF THE INVENTION

It has been discovered that when a partial combustion burner is used to generate hydrogen, carbon monoxide, carbon dioxide, and water and superheated or shift steam is injected into the burner or combustion gases, the superheated steam is additionally heated to a higher temperature and much of the CO produced in the burner is reacted with the steam by the shift reaction to produce greater quantities of $CO_2$ and $H_2$. This has the advantage that the benefits of hydrogen in the cracking process are realized while most of the CO, which is difficult to remove, is converted to $CO_2$ which can be readily scrubbed from the product gases with conventional acid gas absorbents such as caustic solutions or alkanol amine solutions.

When crude oil or crude oil fractions are injected into this hydrogen enriched gaseous mixture, the yield of the desired olefins and aromatics is increased over the use of superheated steam alone while the formation of coke or coke deposits is virtually eliminated. The use of this invention reduces the volume of off-gases to be processed as compared to the use of partial combustion cracking alone.

Additionally, it has been found that if the heavy oils which are generated in the process are used as fuel for the partial combustion burner, any sulfur compounds contained therein are converted mainly to hydrogen sulfide, and a smaller amount to carbonyl sulfide which may be scrubbed out using known techniques. This has the unique advantage that it allows a waste stream of residual oils which may not be suitable for burning in air because of restrictions on sulfur emissions, to be used as some or all of the total fuel required to operate the process.

The invention is broadly a method for the partial combustion cracking of crude oil or highboiling crude oil fractions whereby a carbonaceous fuel is partially burned with an oxidizing gas to form a mixture of hot combustion gases containing more than 5 volume percent carbon monoxide, injecting superheated steam into said combustion gases to react with said carbon monoxide to form a gaseous mixture containing more than 5 volume percent hydrogen, injecting said crude oils or fractions thereof into said steam-hydrogen mixture under time and temperature conditions which crack the crude oils or fractions thereof into gaseous products and favor the formation of ethylene, quenching the gaseous products with a hydrocarbon quench oil, and recovering the lower hydrocarbons.

Another aspect of the invention is a method for the partial combustion cracking of crude oil or high boiling crude oil fractions whereby a heavy recycle oil is recovered by quenching the gaseous products from the cracking step and this heavy recycle oil is recycled for use as a quench oil and/or use as a fuel or fuel supplement.

DESCRIPTION OF THE DRAWING

The present invention is illustrated by the drawing which is a schematic diagram showing the association of the reactor 10, the burner assembly 12, and the quench apparatus 14 together with the separation equipment 44.

DETAILED DESCRIPTION OF THE DRAWING

In the drawing, a reactor assembly 10 is shown which has three zones comprising the partial combustion zone 11, a shift reaction zone 13 and a cracking zone 15 respectively. The reactor assembly is conventional and is illustrated by U.S. Pat. No. 2,698,830, dated Jan. 4, 1955 and U.S. Pat. No. 3,178,488, dated Apr. 13, 1963.

A burner 12 is fed with oxygen or oxygen enriched air through conduit 18. A hydrocarbon fuel and steam are supplied to the burner through conduit 20 and a steam inlet conduit 22 respectively. The process or saturated steam used in conduit 22 preferably has a pressure of from about 50 to 250 pounds per square inch (psig) and a temperature of about 150° and 210° C. This stream is used to mix and atomize the hydrocarbon feed in the burner 12.

Conduit 34 supplies superheated steam to the reaction 10 and/or the burner 12. This superheated steam generally has a pressure of from about 5 to 50 psig and a temperature of about 700° C. to 1100° C. The superheated steam is supplied from a conventional superheater (not shown). The flow of superheated steam is controlled by valves 26, 28, 30 and 32, associated with conduit 24.

Conduit 16 supplies crude oil or highboiling crude oil fractions, i.e. residuums to the cracking zone 15 in the reactor 10. The crude oil is stored in a supply tank (not shown) and is heated by preheater (not shown) to a temperature of about 30° C. to 260° C., depending upon the crude oil, to a flowable viscosity for use.

Cracked hydrocarbons from the reactor 10 are then quenched with a quench apparatus 14. The quench apparatus can be of any well known type such as that shown in U.S. Pat. No. 3,907,661 dated Sept. 23, 1975. However, a falling film quench apparatus is preferred. Hydrocarbon gases are removed through conduit 38 and tars and heavy oils are removed through conduit 40 and fed to the burner 12 by a conduit (not shown).

Outlet conduit 42 is provided to recycle quench oil back to the fuel conduit 20. The flow of the quench oil to the fuel conduit 20 is controlled and/or regulated by valve 43. Thus, if or when a surplus of quench oil is generated during the process, it can be used as a fuel to make the process partially or wholly self sustaining.

Hydrocarbon gases leave the quench apparatus 14 through conduit 38 and enter into the separation apparatus 44 which consists of conventional fractionators, condensors, etc., as shown in the aforementioned U.S. Pat. No. 2,698,830. The desired lower hydrocarbon gases such as ethylene, propylene, and the like are removed by conduit 52.

Light oils from the separation apparatus 44 are pumped by a pump (not shown) through conduit 47 where they diverge through conduits 36 and 48 to supply quench oil to the quench appartus 14 and the fuel conduit 20 respectively. The flow of the light oils is controlled by valves 46 and 50. Valve 50 controls the flow back to the quench apparatus 14 and valve 46 controls the flow to the fuel conduit 20.

DETAILED DESCRIPTION OF THE INVENTION

The temperature of the partial combustion zone is controlled so as to have an average temperature in the range from 1200° to 2200° C. and preferably from 1600° to 2000° C. The average temperature in the shift reaction zone is in the range from 1200° to 1800° C. and preferably 1300° to 1600° C. The average temperature in the cracking reaction zone is in the range from 600° to 1500° C. and preferably 700° to 1100° C. The foregoing average temperatures represent the estimated average temperatures of the top and the bottom of each of the respective zones. Since there are no known temperature probes which can be inserted to directly read these temperatures due to the high temperatures and high erosion, the same information can be restated by indicating the respective outlet temperatures which are measured on the outside of the respective zones. Thus, for the partial combustion zone the outlet temperature is preferably at least 1700° C. In the shift reaction zone the outlet temperature is preferably at least 1100° C. and the cracking reactor zone has a preferred outlet temperature of at least 600° C.

In the partial combustion zone, care should be excercised to insure that the average temperature does not get lower than 1200° C. since the rate of combustion is too slow and inefficient which results in more carbon and methane formation. On the other hand, the upper limit should not be exceeded since the high temperatures will damage the refractory linings of the reactor.

In the shift reaction zone, the average temperature should be kept above 1200° C. since below that temperature there is no significant shift reaction rate i.e. conversion of CO to $H_2$ and $CO_2$. The upper temperature range is limited by the fact that it represents the highest temperature that is known to be obtained under the conditions of this invention.

In the cracking zone, the average temperature should be kept above 600° C. since there is no significant cracking below this temperature. On the other hand, above 1500° C. it has been found that very short residence times are required and that more acetylene is produced with less ethylene.

The hot combustion gases resulting from the partial combustion contain more than 5 volume percent CO and preferably in the range of 6 to 60 volume percent.

The gaseous shift mixture contains more than 5 volume percent $H_2$ and preferably in the range of 6 to 70 volume percent.

The actual composition of these combustion gases can vary considerably depending upon (1) the type of fuel being used (2) the relative amount of oxidizer to fuel and (3) the amount of moderating steam used in protect the refractory. This flexability of composition allows the maximum or optimum conditions for each case to be developed on an individual basis. For instance if a heavy oil or residue is being cracked there will probably be enough excess (quench oil) heavy cracked oil produced to operate the burner. In most of these cases a considerable quantity of CO would be present in the burner gas. But if a relatively low molecular weight paraffinic feedstock is being cracked not enough heavy cracked oil may be produced to sustain the burner, so that some of the light gas ($H_2+CH_4$) produced from the pyrolysis is used in the burner which results in more hydrogen and less CO being present.

For the invention to function it is only necessary that the minimum conditions be met and the preferred range or values will vary depending upon the factors listed above.

The weight ratio of oxygen to fuel used in the burner of this invention for partial combustion is greater than about 1.2:1. The upper limit should not exceed about 3.0:1. This upper limit will vary somewhat depending upon the carbon-hydrogen ratio of the fuel. In any event, the preferred ratio range is normally 2.4:1 to 2.8:1 because this gives the most economical use of the fuel.

The weight ratio of process steam to fuel is in the range from about 0.5:1 to 10:1. The use of these ratios are not critical since the process steam is used primarily to control the temperature in the combustion zone and the above ratios are dependent upon the quantity of oxygen used.

The weight ratio of superheated steam used to burner fuel is in the range from about 2.0:1 to 8.0:1. It has been found that the use of a ratio below this weight ratio results in a poor shift reaction since too little superheated steam is present whereas the use of a ratio above this weight ratio will cool the cracking reaction and slow down the desired shift reaction.

The crude oil or fractions thereof is sprayed or injected into the cracking zone at a ratio from about 0.5 to 8.0 pounds of oil per pound of fuel and preferably 1.5 to 6.0 pounds of oil per pound of fuel to give a residense time from about 0.01 to 1.0 seconds in the reactor and preferably 0.05 to 0.5 seconds.

The oxidizing gas used in the partial combustion zone can be pure oxygen, or air enriched with oxygen.

The fuel which is burned in the partial combustion zone can be any one of the known fuel oils, cracked oils, or a mixture of fuel oils and cracked oils, natural gas, or cracked gases.

The pressure range for the reactor during combustion is in the range from 0–200 psig and preferably in the range from 5–65 psig.

The invention is further illustrated by, and not limited to the following examples:

EXAMPLE 1

Using the apparatus disclosed in the drawing, the following reactants were processed under the given conditions:

| | |
|---|---|
| Fuel: 30° API Domestic Crude | 100 lbs/hr |
| Oxidant: Oxygen | 184 lbs/hr |
| Process steam (200° C.) to burner: | 180 lbs/hr |
| Shift steam: | 549 lbs/hr |
| Cracking Stock: 30° API Domestic Crude | 223 lbs/hr |
| Conditions: | |
| Reactor Pressure | 11.1 psig |
| Temperature Partial Combustion Zone | 1910° C. |
| Shift Steam Inlet Temp. | 905° C. |
| Shift Steam Inlet | Into top of Shift Zone |
| Temperature of Shift Zone Outlet | 1210° C. |
| Temperature of cracking Reactor Outlet | 696° C. |
| Reactor Volume | 1.64 $ft^3$ |
| Residence time | 0.15 sec. |

The following yields in pounds were obtained per 100 lbs of cracking stock.

| | | | |
|---|---|---|---|
| $H_2$ | 3.1 | $C_3H_4$ | 1.1 |
| CO | 5.7 | $C_3H_6$ | 8.8 |
| $CH_4$ | 14.1 | $C_4$ | 5.0 |
| $CO_2$ | 3.0 | $C_5$ | 3.8 |
| $H_2S$ | 0.2 | Benzene | 8.3 |
| $C_2H_2$ | 1.9 | Toluene | 4.5 |
| $C_2H_4$ | 24.8 | $C_6+$[1] | 20.5 |
| $C_2H_6$ | 1.6 | | |

[1] $C_6+$ includes all carbon compounds of $C_6$ or greater except benzene and toluene.

EXAMPLE 2

Using the same apparatus as in Example 1, the following reactants were reacted in a continuous manner:

| | Based on 100 lbs. fuel/hr. |
|---|---|
| Fuel: Heavy Recycle Oil or quench Oil) from Example 1 | 100 lbs/hr |
| Oxidant: Oxygen | 188 lbs/hr |
| Process steam (200° C.) to burner: | 240 lbs/hr |
| Shift steam: | 311 lbs/hr |
| Cracking Stock: 30° API Domestic Crude | 220 lbs/hr |
| Conditions: | |
| Reactor Pressure | 6.1 psig |
| Temperature Partial Combustion Zone | 1903° C. |
| Shift Steam Inlet Temp. | 870° C. |
| Shift Steam Inlet | Into top of Shift Zone |
| Temperature of Shift Zone Outlet | 1163° C. |
| Outlet of Reactor | 697° C. |
| Reactor Volume | 1.64 $ft^3$ |
| Residence time | 0.21 sec. |

The following yields in pounds were obtained per 100 lbs of cracking stock.

| | | | |
|---|---|---|---|
| $H_2$ | 1.3 | $C_3H_4$ | 0.9 |
| CO | 3.9 | $C_3H_6$ | 7.3 |
| $CH_4$ | 11.3 | $C_4$ | 6.2 |
| $CO_2$ | 5.2 | $C_5$ | 1.9 |
| $H_2S$ | 0.2 | Benzene | 7.2 |
| $C_2H_2$ | 2.5 | Toluene | 5.2 |
| $C_2H_4$ | 20.7 | $C_6+$[1] | 25.0 |
| $C_2H_6$ | 1.4 | | |

[1] $C_6+$ includes all carbon compounds of $C_6$ or greater except benzene and toluene.

Control: Total Combustion with Superheated Steam. 49 pounds of fuel oil were burned per hour with 145 pounds of oxygen per hour which resulted in essentially complete combustion of the fuel to $CO_2$ and $H_2O$. Additionally, 306 pounds of 200° C. process steam was added to the burner to maintain the temperature below 1900° C. The resulting gaseous mixture was combined with 300 pounds of steam per hour which had been superheated to 870° C. to yield a gaseous heat carrier containing in volume percentages 0.6 $H_2$; 0.3 CO; 8.9 $CO_2$; and 90.2 $H_2O$ at a temperature of 1460° C.

Into this gaseous heat carrier, 158 pounds per hour of vacuum gas oil (650°–1050° F. boiling range) was sprayed using 75 pounds of 200° C. process steam per hour for atomization. The yield of products are shown in Table I.

EXAMPLE 3

82 pounds per hour of fuel oil were burned with 163 pounds of oxygen per hour. Additionally, 255 pounds per hour of 200° C. process steam was added to maintain the flame temperature below 1900° C. This mixture was deficient in oxygen and resulted in the partial combustion of the fuel. The gaseous mixture contained substantial portions of CO and $H_2$ in addition to $CO_2$ and $H_2O$. The volume percentages in the gaseous mixture were 12.5 $H_2$; 12.5 CO; 11.2 $CO_2$; 63.4 $H_2O$.

The resulting gaseous mixture was combined with 300 pounds per hour of steam which had been superheated to 870° C. At these conditions with a residence time sufficient to achieve equilibrium, 30% of the CO present was converted to $CO_2$ with a corresponding increase in $H_2$ content.

The resulting gaseous heat carrier had a temperature of 1460° C. and consisted of (volume percentages) 9.8 $H_2$; 5.3 CO; 8.9 $CO_2$; and 75.9 $H_2O$.

Into this gaseous heat carrier 158 pounds per hour of vacuum gas oil was sprayed using 75 pounds per hour of process steam (200° C.). The yields of products are shown in Table I. It is to be noted that the yield of ethylene is increased about 28% over the control and thus the injection of superheated steam into the partial combustion gases is highly effective to increase the yield of ethylene.

A detailed comparison of Example 3 and the control is shown in Table II.

TABLE I

| Yields in pounds per 100 pounds of feestock. | | |
|---|---|---|
| | Control | Example 3 |
| $H_2$ | 1.7 | 1.0 |
| CO | 5.0 | 3.0 |
| $CH_4$ | 10.3 | 13.7 |
| $CO_2$ | 0.2 | 2.4 |
| $H_2S$ | 0.7 | 1.1 |
| $C_2H_2$ | 2.7 | 2.7 |
| $C_2H_4$ | 20.9 | 26.8 |
| $C_2H_6$ | 1.0 | 1.1 |
| $C_3H_4$ | 0.8 | 0.9 |
| $C_3H_6$ | 4.3 | 5.8 |
| $C_4$ | 3.0 | 4.0 |
| $C_5$ | 1.2 | 1.3 |
| Benzene | 7.5 | 8.0 |
| Toluene | 4.7 | 3.0 |
| $C_6$+ | 39.6 | 29.3 |

TABLE II

| | Control | Example 3 |
|---|---|---|
| Fuel, (lb. per hour) | 49 | 82 |
| Oxygen (lb. per hour) | 145 | 163 |
| 200° Steam (lb. per hour) | 306 | 255 |
| Combustion Temp. °C. | 1900 | 1900 |
| 870° C. Steam (lb. per hour) | 300 | 300 |
| Total lbs. Carrier Gas | 800 | 800 |
| Temp. of Carrier Gas, °C. | 1460 | 1460 |
| Feedstock (lb. per hour) | 158 | 158 |
| Products, (lbs. per hour) | | |
| $H_2$ | 2.7 | 9.6 |
| CO | 8.7 | 44.4 |
| $CO_2$ | 161.2 | 181.0 |
| $CH_4$ | 16.3 | 21.7 |
| $C_2H_2$ | 4.2 | 4.1 |
| $C_2H_4$ | 33.0 | 42.3 |
| $C_2H_6$ | 1.5 | 1.8 |
| $C_3H_4$ | 1.3 | 1.4 |
| $C_3H_6$ | 6.8 | 9.1 |
| $C_4$+ | 83.1 | 73.8 |
| $H_2O$ | 638.1 | 567 |
| $H_2S$ | 1.1 | 1.7 |

We claim:

1. A method for the cracking of crude oils or high boiling fractions thereof to obtain lower hydrocarbons with a high proportion of ethylene which comprises, (1) partially burning a carbonaceous fuel with an oxidizing gas and process steam for temperature control in a partial combustion zone to form a mixture of hot combustion gases having an average temperature in the range from 1200° to 2200° C. and containing more than 5 volume percent carbon monoxide, (2) injecting a substantial amount of superheated steam into said combustion gases in a shift reaction zone having an average temperature in the range from 1200° to 1800° C. to react with said carbon monoxide to form a gaseous mixture containing more than 5 volume percent hydrogen and carbon dioxide, (3) injecting said crude oils or fractions thereof into said steam-hydrogen mixture in a cracking zone having an average temperature in the range of from 600° to 1500° C. under time and temperature conditions which crack the crude oils or fractions thereof into gaseous products and favor the formation of ethylene, (4) quenching the gaseous products with a hydrocarbon quench oil, and (5) recovering the lower hydrocarbons.

2. The process as set forth in claim 1 wherein the gas formed by said partial combustion has an average temperature in the range of 1300° to 1600° C.

3. The process as set forth in claim 1 wherein the weight ratio of superheated steam to fuel is in the range of 2:1 to 8:1.

4. The process as set forth in claim 1 wherein the crude oils or fractions thereof are cracked at a temperature in the range from 700° to 1100° C. and have a residence time of 0.01 to 1.0 seconds.

5. The process as set forth in claim 1 wherein said superheated steam has a temperature in the range of 700° to 1100° C.

6. A method for the cracking of crude oils or fractions thereof to obtain lower hydrocarbons with a high proportion of ethylene which comprises, (1) partially burning a hydrocarbon oil with an oxidizing gas and process steam for temperature control in a partial combustion zone to form a mixture of hot combustion gases having an average temperature in the range from 1200° to 2200° C. and containing more than 5 volume percent carbon monoxide, (2) injecting a substantial amount of superheated steam into said combustion gases in a shift reaction zone having an average temperature in the range from 1200° to 1800° C. to react with said carbon monoxide to form a gaseous mixture containing more than 5 volume percent hydrogen and carbon dioxide, (3) injecting said crude oils or fractions thereof into said steam-hydrogen mixture in a cracking zone having an average temperature in the range of from 600° to 1500° C. under time and temperature conditions which crack the crude oils or fractions thereof into gaseous products and favor the formation of ethylene, (4) quenching the gaseous products with a hydrocarbon quench oil in a quench zone, (5) recovering the quench oil from said products, (6) recycling a portion of said quench oil to said quench zone and another portion to said combustion zone to be blended with said hydrocarbon oil and partially burned, and (7) recovering the lower hydrocarbons.

7. The process as set forth in claim 6 wherein the gas formed by said partial combustion has an average temperature in the range of 1300° to 1600° C.

8. The process as set forth in claim 6 wherein the weight ratio of superheated steam to fuel is in the range of 2:1 to 8:1.

9. The process as set forth in claim 6 wherein the crude oils or fractions thereof are cracked at a temperature in the range from 700° to 1100° C. and have a residence time of 0.01 to 1.0 seconds.

10. The process as set forth in claim 6 wherein said superheated steam has a temperature in the range of 700° to 1100° C.

11. The process of claim 1 wherein the carbonaceous fuel is a crude oil or a high boiling franction thereof.

12. The process of claim 2 wherein the carbonaceous fuel is a crude oil or a high boiling fraction thereof.

13. The process of claim 3 wherein the carbonaceous fuel is a crude oil or a high boiling fraction thereof.

14. The process of claim 4 wherein the carbonaceous fuel is a crude oil or a high boiling fraction thereof.

15. The process of claim 5 wherein the carbonaceous fuel is a crude oil or a high boiling fraction thereof.

* * * * *

UNITED STATES PATENT OFFICE
CERTIFICATE OF CORRECTION

PATENT NO. : 4,264,435
DATED : April 28, 1981
INVENTOR(S) : Arthur E. Read, Jr., Milton S. Wing, William P. Hancock It is certified that error appears in the above-identified patent and that said Letters Patent are hereby corrected as shown below:

Column 1, line 55; change "reduced" to --reduces--.

Column 3, line 15; change "and" (second occurrence) to --to--.

Column 3, line 18; change "reaction" to --reactor--.

Column 3, line 33; after "quench" add--oil in quench--.

Column 4, line 17; change "excer" to --exer--.

Column 7, line 24 change "feestock" to --feedstock--.

Signed and Sealed this

*Twentieth* Day of *October 1981*

[SEAL]

*Attest:*

GERALD J. MOSSINGHOFF

*Attesting Officer* *Commissioner of Patents and Trademarks*